United States Patent [19]

Solomon et al.

[11] Patent Number: 4,880,140

[45] Date of Patent: Nov. 14, 1989

[54] FILTER-SEPARATOR POUR-OUT CAP

[76] Inventors: David E. Solomon, 3415 Woodlea, Ann Arbor, Mich. 48103; William J. Hillegas, 3630 Middleton, Ann Arbor, Mich. 48105

[21] Appl. No.: 186,507

[22] Filed: Apr. 26, 1988

[51] Int. Cl.[4] ..... B65D 37/00

[52] U.S. Cl. ..... 220/371; 220/855 P; 222/571

[58] Field of Search ..... 220/371, 367, 855 P; 222/480, 481, 553, 562, 565, 566, 567, 568, 571; 215/307, 308

[56] References Cited

U.S. PATENT DOCUMENTS

| | | | |
|---|---|---|---|
| 2,134,281 | 10/1938 | Illch | 222/571 |
| 2,704,174 | 3/1955 | Uxa | 222/571 |
| 2,733,775 | 2/1956 | Dupure | 220/371 X |
| 2,743,844 | 5/1956 | Livingstone | 220/855 P |
| 3,297,211 | 1/1967 | Unger | 222/567 X |
| 4,533,068 | 8/1985 | Meierhoefer | 222/481 X |

*Primary Examiner*—Steven M. Pollard

[57] ABSTRACT

A filter-separator pour-out cap for attachment to the neck opening of a container to separate particulate material from a liquidic suspension in the container when the container is tipped to pour out its contents. The cap comprises a filter-separator section having an upstream face at which flow from the container enters and a downstream face at which flow exits. This section comprises successive elements that are spaced axially apart from each other and are constructed and arranged to present at the upstream face juxtaposed uniformally spaced apart edges that define the entrances of openings that pass through the filter-separator from the upstream face to the downstream face. These elements have, in transverse cross section, a taper which narrows in the direction from the upstream face to the downstream face so that the openings are of progressively increasing taper in the same direction. In one embodiment of the invention these elements are identical circular rings. In another, the elements are convolutions of a helix. Various embodiments of caps are disclosed.

14 Claims, 4 Drawing Sheets

FILTER-SEPARATOR POUR-OUT CAP

BACKGROUND AND SUMMARY OF THE INVENTION

This invention relates generally to the separation of particulate materials from liquidic suspension. More specifically, the invention relates to a novel and unique filter-separator pour-out cap for a container that has particulate materials in liquidic suspension. The cap enables the liquid to be poured from the container free of particulate materials above a given size while such particulates remain trapped inside the capped container.

Industrial processes in which particulate materials are held in liquidic suspension often require separation of the particulate materials from the liquid. Devices, often called filters, separators, or filter-separators, are used for this purpose. Generally they are of two types.

The first type is a screen that comprises woven wires, either metal or plastic. It possesses a unique characteristic in that while it is woven to comprise square openings, those openings are really three dimensional in nature because of the weaving of the wires. If the particulate material that is being separated contains some particles whose dimensions are essentially equal to those of the square openings in the filter screen, then such particles often become entrapped in the openings. Because of the three dimensional nature of the woven filter, it is rather difficult, and often impossible, to dislodge these entrapped particles, even by backwashing. If there are many particles of this particular size that become entrapped in many of the square openings of the filter, the filter becomes "blinded", ceasing to function effectively in the areas of blinding, with attendant attenuation of flow.

The second type of filter is typically made of woven paper or selectively etched material. In either case, this type of filter is also three dimensional in character and subject to blinding. Because both filter types are relatively inexpensive. They are typically replaced by fresh ones when they become excessively blinded.

In certain processes an unacceptable degree of filter blinding may occur at times or under circumstances that are not especially conducive to filter replacement. Moreover, the mere act of replacing a filter involves the expenditure of a certain amount of time and effort, even if the time and circumstances are not inconvenient for filter replacement, and even though the cost of filters of the aforedescribed types may be relatively inexpensive. Furthermore, for additional reasons, it is usually necessary to periodically replace filters with brand new ones, a further cost for the overall process.

Certain filtering, or separating, operations are conducted on particulate-containing liquidic media that are in bottles. Placement of a filter screen over the bottle opening and pouring the media through the filter is one typical type of filtering procedure. Generally, the filter area is comparatively small, and clogging or blinding may seriously impair the dispensing of the liquid before the entire liquid contents of the container have been poured out.

The present invention relates to a new and improved filtering, or separating, device that filters particulate material from particulate-containing liquidic suspension in a new and unique way that avoids the blinding tendency of three dimensional type filter screens. More specifically, the invention involves a new "two dimensional" principle of filtering which avoids the particulate entrapping effect that characterizes the three dimensional types of filters described above.

The invention has special advantages in a pour-out cap for a container because one it does not have this blinding tendency that characterizes three dimensional types of filters and two, even if separated particulate material tends to begin obstructing flow through the cap, such clogging can be relieved by turning the container upright and/or by moderately shaking or jarring the container.

A filter-separator device embodying principles of the present invention can be conveniently manufactured by known fabrication techniques. A preferred method of making the device is through the use of plastic materials which can be molded to desired shapes by means of suitably constructed molds. It is possible, however, to fabricate the device of the present invention by other techniques.

The foregoing features, advantages, and benefits of the invention, along with additional ones, will be seen in the ensuing description and claims which should be considered in conjunction with the accompanying drawings. The drawings disclose a preferred embodiment of the invention according to the best mode contemplated at the present time in carrying out the invention.

DESCRIPTION OF THE PREFERRED EMBODIMENT

Figure 1:
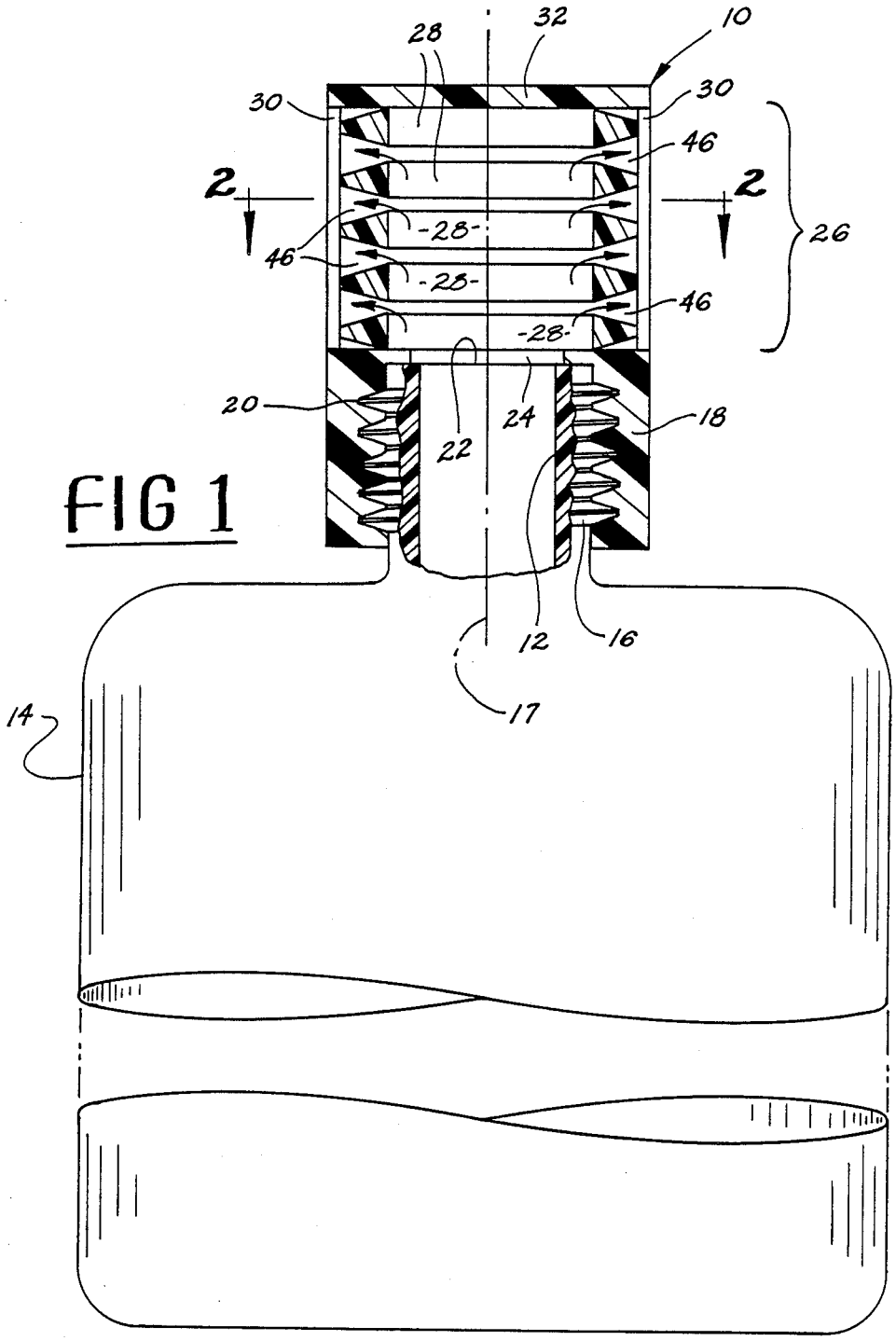
FIG. 1 is a longitudinal cross sectional view through the neck opening of a container on which is disposed a pour-out filter-separator cap embodying principles of the present invention.
Figure 2:
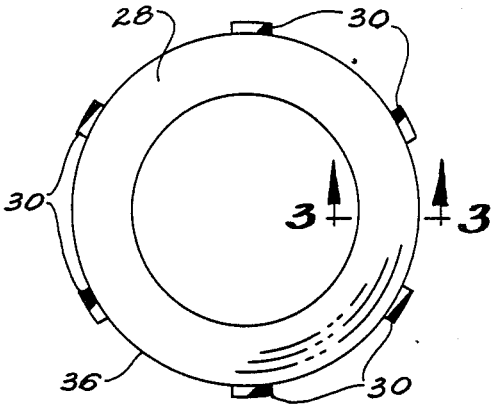
FIG. 2 is a transverse cross sectional view taken in the direction of arrows 2—2 in FIG. 1.
Figure 3:
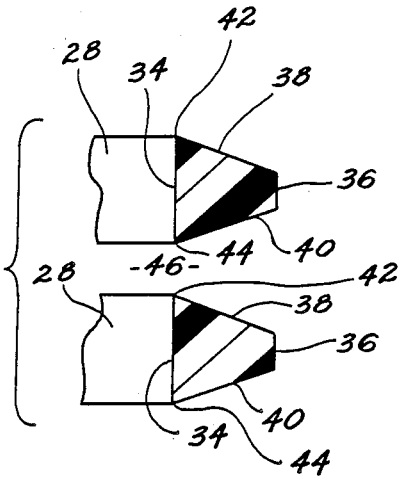
FIG. 3 is an enlarged fragmentary view taken in the direction of arrows 3—3 in FIG. 2.

FIGS. 1, 2 and 3 portray a first embodiment of filter-separator cap 10 that is shown on the neck 12 of a container, or bottle, 14. Container 14 is merely representative, and it is to be understood that filter caps embodying the present invention may be used with various embodiments of containers.

The illustrated container neck 12 is located centrally in the top wall of the container and comprises an external helical thread 16 onto which filter-separator cap 10 is threaded. Cap 10 has a generally circular cylindrical configuration about its longitudinal axis 17 and comprises a solid cylindrical walled portion 18 that comprises an internal helical thread 20 for threading the cap onto thread 16. Thread 20 has a sufficient number of convolutions to allow the cap to be screwed sufficiently onto container neck 12 that a satisfactory sealing effect is attained so that fluid does not leak out through the engaged threads when liquid is being poured out of the container through cap 10 as the container is being tipped from the illustrated upright position to an inclined pouring position. In the drawing figure the finish end 22 of neck 12 is shown in sealing contact with an internal circular annular shoulder 24 of cap 10 when the latter is tightened fully onto the container neck.

The filter-separator section of cap 10 is designated by the reference numeral 26 and extends coaxially of the filter cap a certain distance beyond the cylindrical walled portion 18 that contains internal thread 20. It is to be understood that the illustrated preferred embodiment is intended to portray general principles of the invention, and therefore it is properly construed as being representative of those principles.

The illustrated construction for section 26 comprises a succession of five identical circular rings 28 that are held in assembly at uniform axial spacing distances along axis 17 by means of a series of axially extending bars 30 that are arranged at intervals around the outside of rings 28. A solid circular disc 32 forms a closure for the distal end of filter-separator section 26 that lies opposite the cylindrical walled section 18 which forms the proximal end of the cap.

Each ring 28 has an inside diameter (I.D.) that is approximately the same as the I.D. of thread 20, and it has an outside diameter (O.D.) that is less than the O.D. of section 18 by an amount equal to twice the thickness of a bar 30. The O.D. of disc 32 is essentially the same as the O.D. of section 18. In this way, the assembled cap comprises the radially outward sides of bars 30 substantially flush with the O.D.'s of section 18 and disc 32.

A transverse cross section through a ring 28 shows it to have a circular cylindrical inside wall 34 that is coaxial with axis 17, a circular cylindrical outer wall 36, also coaxial with axis 17, and transverse walls 38 and 40, respectively, such that the four walls 34, 36, 38 and 40 form a regular trapezoid, or keystone, shape. In other words, the cross section of a ring may be considered to have a taper that narrows in the radially outward direction relative to the cap axis. The surfaces of outer walls 36 serve to join rings 28 to bars 30 in the previously described manner of uniform spacing between the rings.

The uniform spacing between two immediately consecutive rings 28 is a minimum at the rings' I.D. while it is a maximum at the rings' O.D. The junctions of each wall 34 with adjoining walls 38 and 40, respectively, define respective circular edges 42, 44 at the minimum spacing distance between immediately consecutive rings. It is these edges 42, 44 that provide the "two dimensional" filtering effect for cap 10 in filtering particulate material from a liquidic suspension in container 14 when the container is tipped to pour its contents out through cap 10.

The juxtaposed edges 42, 44 of each pair of immediately consecutive rings 28 define a circular opening 46 between each pair of immediately consecutive rings 28. As measured across juxtaposed edges 42, 44, each of these openings 46 has a substantially constant axial dimension extending a full 360 degrees around the interior side of the cap. This is considered the upstream side, or upstream face, of the filter-separator. Because of the tapers of walls 38, 40, openings 46 progressively increase in axial dimension in the radially outward direction so that the particulate filtering action takes place entirely at the I.D. of the filter-separator section.

Any particulate material whose dimensions are equal to or greater than the axial dimension between juxtaposed edges 42 and 44 across each opening 46 will remain on the container side (upstream face) of the filter-separator section when the contents are being poured out of the container. Liquid material and any particulates whose dimensions are smaller than this axial dimension can pass through section 26 via openings 46.

Should a piece of particulate material that has a dimension which is essentially the same as the axial dimension of an opening 46 as measured across juxtaposed edges 42 and 44 becomes lodged between such edges, the contact is essentially two dimensional in nature, not three dimensional as in the woven mesh filters described earlier. Accordingly, any such particle that becomes so lodged may often be dislodged by shaking or jarring the container and/or by turning the container more upright. In those instances where backwashing would conceivably be appropriate, such lodged particles may be dislodged by that means.

The particular dimensions for a filter cap embodying principles of the present invention will obviously depend upon several considerations including the size of the container with which it is to be used, and the natures of the liquid media and of the particulate material that is to be separated. Hence, filter caps with different numbers of rings, or different identical spacing distances between rings are contemplated. It is further contemplated that filter caps having various dimensions and different shapes for rings 28 can also be constructed in accordance with the principles of the present invention.

The illustrated tapered shape for rings 28 is advantageous because the increasing size of the openings 46 in the radially outward direction from edges 42, 44 will not impede the further passage of any particles that may clear the spacing distance between juxtaposed edges 42, 44 even though this could mean that in some instances a trapped particle whose size is exactly that of the minimum spacing distance between consecutive rings could escape when an attempt is made to dislodge it. However, it is to be recognized that the exact minimum size of particles that can be separated through use of a filter cap of the invention is subject to whatever tolerance variations are inherent in the manufacture of the filter cap using whatever fabrication processes are involved for a particular cap design.

Moreover, since the critical dimension for filtering is the distance between juxtaposed edges 42, 44 of immediately consecutive rings 28, bars 30 are spaced circumferentially apart farther than this critical dimension. Preferably, the circumferential bar spacing and the circumferential bar widths are such that the bars provide sufficient strength to prevent undesired deformation of the rings that could adversely affect the axial spacing distance between rings and to pose minimum obstruction to the radially outward flow through openings 46.

With regard to fabrication processes for cap 10, it is contemplated that the filter caps can be constructed by conventional molding techniques using suitable plastic materials. Molding could be such, depending upon complexity of the molds themselves, that the caps can be made as one piece. Alternatively, a cap may be fabricated as two or more separate parts or sections that are subsequently joined in assembly. It is important for the construction of the filtering section to be sufficiently strong that the dimensions between consecutive rings are accurately maintained. Constructional techniques other than fabrication by plastic molding are however contemplated in practice of the invention.

The cap of FIG. 1 illustrates a configuration which is in substitution of a conventional closure cap (not shown) that normally closes the contents of container 14 until such time as the media within the container is to be poured out. At such time, the conventional closure cap is removed and replaced by the illustrated pour-out cap 10. When the container is inverted to a pour-out position, the contents of the container flow in the manner indicated by the arrows in FIG. 1 with liquid material and any particles smaller than the filtering-separating capacity of the cap passing through the free spaces 46 between rings 28 while particles larger than this filtering-separating capacity do not pass through. If particles tend to collect inside the cap in a sufficient amount that prevents, or unduly restricts, the contents of the container from being emptied, it is convenient simply to periodically shake or jar the container and/or momentarily turn it right side up, as required, until such time as substantially the entire liquid contents have been poured out. Thus, the cap of the present invention greatly facilitates the emptying of a container containing particulate material in liquidic suspension so that particles above a certain size are inherently separated during the pouring out process without blinding of the filtering section of the cap.

Figure 4:
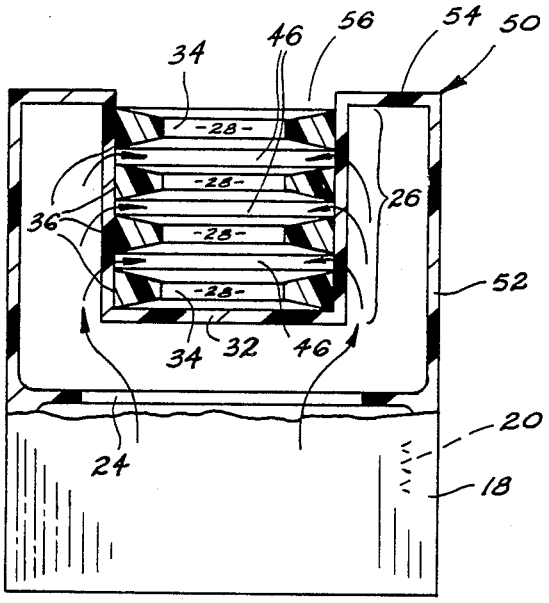
FIG. 4 is a longitudinal view in partial cross section through a second embodiment of filter-separator cap according to the present invention.

In FIG. 4 a second embodiment of filter-separator cap is designated by the reference numeral 50. Like cap 10, cap 50 comprises a solid cylindrical walled portion 18 that comprises an internal thread 20 for threading the cap onto the threaded neck of a container. Cap 50 also includes the internal shoulder 24 for sealing against the finish end of the container neck. Cap 50 has a filter-separator section 26 that consists of a succession of identical circular rings 28 held in assembly at uniform axial spacing distances by means of axially extending bars 30. A solid circular disc 32 also forms a closure for one end of filter-separator section 26. However, the manner in which rings 28, bars 30, and disc 32 are constructed and arranged in cap 50 differs from the manner of their organization and arrangement in cap 10.

Cap 50 comprises a circular cylindrical outer wall portion 52 that is of the same outside diameter as, and forms an axial continuation of, wall portion 18. The axial end of wall portion 52 that lies opposite shoulder 24 joins with a circular annular radial wall 54 that is concentric with the cap axis 17. Filter-separator section 26 is supported on the inner periphery of wall portion 54 such that section 26 is disposed concentrically with, and circumferentially bounded by, axial wall portion 52. The length of section 26 is, however, slightly shorter than that of axial wall section 52 so that the axial end of section 26 which is proximal to the container when cap 50 is installed thereon is in axially spaced relation to shoulder 24. In this way, when the cap is placed on a container and the container contents are poured out through the cap, those contents pass through the circular opening that is bounded by shoulder 24 and hence, around the outside of section 26 in the manner portrayed by the arrows in FIG. 4.

A further difference in the filter-separator section 26 of FIG. 4 is that the radially outer face thereof is the upstream side, or upstream face, and hence, in the embodiment of FIG. 4, the tapers of rings 28 are reversed from FIG. 1. Thus, in FIG. 4, the axially outer wall 36 is the larger axial wall of each ring while the radially inner wall 34 is now narrower than wall 36. The walls 38 and 40 taper such that in cross section each ring 28 of cap 50 narrows in the radially inward direction relative to the cap axis.

Bars 30 are disposed circumferentially spaced apart around section 26 with the spacing distance between immediately adjacent bars being greater than the minimum spacing distance across an opening 46. In cap 50 it is the corners defined by the intersection of wall 36 with walls 38 and 40 which define the edges that provide the "two dimensional" filtering effect.

Disc 32 closes the axial end of section 26 that is proximal the container while the opposite axial end forms a circular exit opening 56 through which the contents of the container are poured out after the filtering/separating effect of section 26. Although not shown in FIG. 4, it would be possible to place a removable cap onto the distal end of filter-separator cap 50 for closing opening 56.

Figure 5:
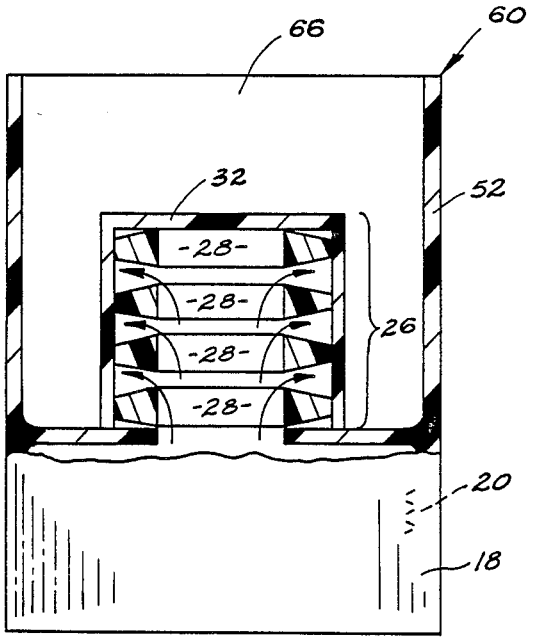
FIG. 5 is a longitudinal view in partial cross section through a third embodiment of filter-separator cap.

In FIG. 5, a third embodiment of filter-separator cap is designated by the numeral 60. Like cap 10, cap 60 comprises a solid cylindrical walled portion 18 that comprises an internal thread 20 for threading the cap onto the threaded neck of a container. The organization and arrangement of the filter-separator section 26 of cap 60 is generally the same as that of cap 10. It differs, however, in that the rings 28 and disc 32 are of smaller diameters than their counterparts in FIG. 1. Furthermore, the filter-separator section of cap 60 is uprightly supported from the inner periphery of shoulder 24. The taper of rings 28 in cap 60 narrows in the radially outward direction so that when the container containing cap 60 is tipped for pouring, the direction of flow is in the manner indicated by the arrows in FIG. 5. Cap 60 further includes a circular wall portion 52 that is of the same O.D. as, and projects axially from, section 18. The length of section 52 exceeds the axial length of section 26 so that when the contents of the container are being poured out through cap 60, wall 52 aids in directing flow through the circular opening 66 that is defined by the distal end of wall portion 52.

Figure 6:
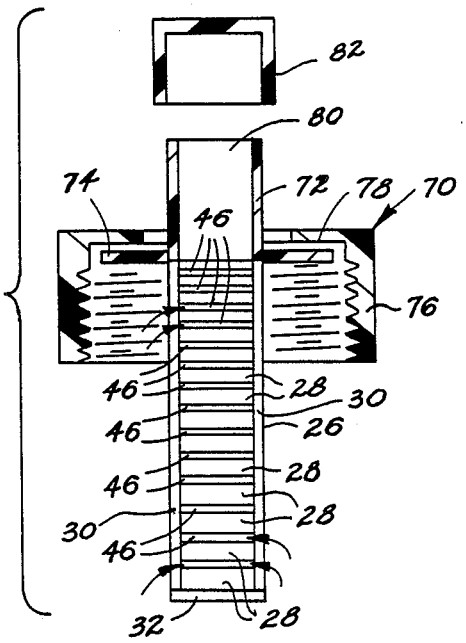
FIG. 6 is a longitudinal cross sectional view through a fourth embodiment of filter-separator cap.

The fourth embodiment of cap is designated by the reference numeral 70 in FIG. 6. Cap 70 differs from the previous caps in that the filter-separator section 26 passes through the neck of a container when the cap is installed thereon. Section 26 of cap 70 has an organization and arrangement for its rings 28, bars 30, and closure disc 32 that is analogous to that of cap 50. Hence, when the container on which the cap 70 is installed is tipped to pour out the container contents, the flow is in the direction indicated by the arrows in FIG. 6.

The filter-separator section 26 of cap 70 further comprises a solid circular cylindrical axial wall 72 that forms a continuation of section 26 in the direction away from the interior of the container. A circular flange 74 is provided at the junction of wall portion 72 and section 26, and a threaded nut 76 that has a circular radially inwardly directed flange 78 is used to removably attach cap 70 to the threaded container neck. When cap 70 is installed on a container, flange 74 will be disposed against the finish end of the container neck. The circular opening in nut 76 that is bounded by flange 78 has sufficient clearance to allow the nut to be fitted over axial wall portion 72 and the nut threaded onto the threaded container neck causing flange 78 to tightly press flange 74 against the finish end of the neck. Through suitable choice of materials, a sufficient sealing can take place simply by suitable tightening of the nut onto the container neck. However, it is possible to place a lip seal (not shown) over the edge of flange 74 which would provide a seal to both the container neck and to nut 76 when the nut is tightened onto the container neck. The distal end of axial wall 72 forms a circular opening 80 through which the contents of the container exit the cap after having passed through filter-separator section 26. This exit opening 80 may be covered by a removable cap 82 that is removed when the contents are to be poured out.

Figure 7:
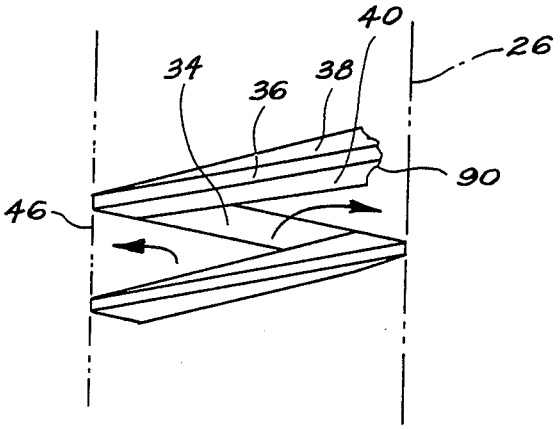
FIG. 7 is a fragmentary longitudinal view illustrating a different configuration for the filter-separator portion of a filter-separator cap.

All previous embodiments have shown the filter-separator section to be constructed of concentric uniformly spaced apart identical rings which provide uniform axially spaced apart openings. FIG. 7 portrays an alternate configuration that can be used with caps, such as those of FIGS. 1—3 and 5.

Instead of comprising individual rings and individual openings, the filter-separator section 26 is constructed in a regular helical shape 90 having a constant cross section and a constant pitch. This manner of constructing the filter-separator section yields one or multiple convolutions of the helix defining a single helical opening. For the illustrated helix, the flow direction is in the manner indicated by the arrows in FIG. 7, and therefore this embodiment would be suitable for caps such as those of FIGS. 1—3, and 5. For embodiments such as FIGS. 4 and 6, the taper of the cross section would be reversed from that shown in FIG. 7. If the construction of the embodiment of FIG. 7 is sufficiently rigid to maintain constant minimum spacing distance between successive convolutions, the use of bars 30 can be omitted. If this is not the case, bars can be attached at various points around the periphery, either inside or outside, for giving appropriate rigidity to the convolutions of the helix to maintain constant the spacing distance between successive convolutions. It will be appreciated that while the helix can be fabricated as a single piece, the individual convolutions constitute elements of the helix, just as the separate rings of the other embodiments constitute elements of their filter-separator sections.

As should be apparent from the foregoing description, the effective area of the filter-separator section is a function of the need to maintain suitable structural strength for the rings and the availability of axial and radial space. For example, the effective area can be increased by increasing the dimensions of filter-separator section 26 axially and/or radially.

While a preferred embodiment of the invention has been disclosed, it will be appreciated that principles are applicable to other embodiments.

What is claimed is:

1. A filter-separator pour-out cap for a container comprising an attachment section for attaching the cap to a container, a filter-separator section, and means for supporting said filter-separator section on a container via said attachment section, said filter-separator section having an upstream face at which flow from the container enters the filter-separator section and a downstream face at which flow exits the filter-separator section, said filter-separator section comprising successive elements that are spaced axially apart from each other and are constructed and arranged to present at the upstream face of the filter-separator section juxtaposed uniformly spaced apart sharp edges that define the entrances of openings that pass through the filter-separator section from the upstream face to the downstream face, the spacing distance between immediately consecutive elements being such that substantially identical spacing distances are provided between juxtaposed edges of immediately consecutive elements at the upstream face and the spacing distance between immediately consecutive elements along said openings from just beyond said juxtaposed edges to the downstream face exceeds the spacing distance that exists between the juxtaposed edges of immediately consecutive elements at the upstream face.

2. A filter-separator cap as set forth in claim 1 in which said elements are constructed and arranged such that in tranverse cross section each element comprises a taper such that the spacing distance along said openings between immediately consecutive elements progressively increases from just beyond said juxtaposed edges at the upstream face to the downstream face.

3. A filter-separator cap as set forth in claim 1 in which said elements are identical in transverse cross section so that consecutive ones of said openings are at regular increments of distance axially of each other.

4. A filter-separator cap as set forth in claim 1 in which the upstream face of said filter-separator section is disposed radially outwardly relative to the downstream face.

5. A filter-separator cap as set forth in claim 1 in which the upstream face of said filter-separator section is disposed radially inwardly relative to the downstream face.

6. A filter-separator cap as set forth in claim 1 in which said elements comprise a series of individual rings that are spaced apart axially from each other and are joined by axial bars.

7. A filter-separator cap as set forth in claim 6 in which said bars join with said series of rings on wall surfaces of said rings that are other than on the upstream face of said filter-separator section.

8. A filter-separator cap as set forth in claim 6 in which said bars are arranged parallel to each other.

9. A filter-separator cap as set forth in claim 1 in which said elements are successive convolutions of a regular helix.

10. A filter-separator cap as set forth in claim 9 in which said elements are constructed and arranged such that said openings through said filter-separator section have tapers that progressively increase in size from just beyond said juxtaposed edges at the upstream face to the downstream face.

11. A filter-separator cap as set forth in claim 1 in which said elements are coaxial with said attachment section such that the upstream and downstream faces of said filter-separator section lie on respective imaginary circular cylindrical surfaces that are coaxial with the attachment section.

12. A filter-separator cap as set forth in claim 11 in which one axial end of said filter-separator section is distal and the other axial end of said filter-separator section proximal relative to a container, and said means for supporting said filter-separator section comprises means extending from said attachment section to the distal axial end of said filter-separator section, said last-mentioned means including an axial wall that is in circumferentially outwardly spaced relation to said filter-separator section and circumferentially bounds said filter-separator section.

13. A filter-separator cap as set forth in claim 11 in which one axial end of said filter-separator section is distal and the other axial end of said filter-separator section proximal to a container, and said means for supporting said filter-separator section comprises means supporting the proximal axial end of said filter-separator section on said attachment section, and including an axial wall, independent of said last-mentioned means, that is in circumferentially outwardly spaced relation to said filter-separator section and circumferentially bounds said filter-separator section.

14. A filter-separator cap as set forth in claim 11 in which said attachment section comprises a threaded nut that separably engages a flange on said filter-separator section for attachment of the cap to a container.

* * * * *